United States Patent [19]

Yuuki

[11] 4,191,143

[45] Mar. 4, 1980

[54] EGR/IGNITION TIMING CONTROL SYSTEM FOR AN INTERNAL COMBUSTION ENGINE

[75] Inventor: Kiyoshi Yuuki, Susono, Japan

[73] Assignee: Toyota Jidosha Kogyo Kabushiki Kaisha, Toyota, Japan

[21] Appl. No.: 940,648

[22] Filed: Sep. 8, 1978

[30] Foreign Application Priority Data

Mar. 8, 1978 [JP] Japan ..... 53-26147

[51] Int. Cl.[2] ..... F02P 5/04; F02M 25/06

[52] U.S. Cl. ..... 123/117 A; 123/119 A

[58] Field of Search ..... 123/117 A, 119 A

[56] References Cited

U.S. PATENT DOCUMENTS

| | | | |
|---|---|---|---|
| 3,915,132 | 10/1975 | Thornburgh | 123/117 A |
| 4,031,869 | 6/1977 | Onishi et al. | 123/117 A |
| 4,083,335 | 4/1978 | Ohata | 123/117 A |
| 4,098,245 | 7/1978 | Ohata | 123/117 A |
| 4,124,006 | 11/1978 | Rodenkirch | 123/117 A X |

*Primary Examiner*—Tony Argenbright

*Attorney, Agent, or Firm*—Finnegan, Henderson, Farabow

[57] ABSTRACT

An EGR/ignition timing control system for an internal combustion engine having a vacuum advancer and an EGR system, wherein the control system includes a vacuum switch which is operated at the same critical vacuum as an EGR valve of the EGR system and a solenoid valve which is operated by the vacuum switch so as to trap, in cooperation with a check valve, the maximum vacuum supplied to the vacuum advancer as long as the EGR valve is open and is effecting exhaust gas recirculation.

8 Claims, 7 Drawing Figures

EGR/IGNITION TIMING CONTROL SYSTEM FOR AN INTERNAL COMBUSTION ENGINE

BACKGROUND OF THE INVENTION

The present invention relates to an ignition timing control system for an internal combustion engine having an exhaust gas recirculation (EGR) system, and particularly to an EGR/ignition timing control system which provides the desirable vacuum advancing of ignition timing in relation to EGR control so as to adapt ignition timing to EGR operation of the engine.

An EGR system, which recirculates a part of the exhaust gases of an engine from its exhaust system to its intake system, has an EGR passage and an EGR valve incorporated in the EGR passage and is adapted to recirculate a controlled amount of exhaust gases from the exhaust system to the intake system in accordance with operational conditions of the engine. Such an EGR valve is generally a vacuum-operated diaphragm valve which has a diaphragm means and is adapted to be opened when the diaphragm means is supplied with a vacuum greater than a predetermined level, wherein the vacuum supplied to the diaphragm means is taken from a vacuum port provided in the intake system of the engine so as to open to the intake passage at a position which is upstream of the throttle valve incorporated in the intake passage when the throttle valve is fully closed and which is downstream of the throttle valve when it is opened beyond a predetermined opening. The vacuum taken from this vacuum port changes in accordance with the opening of the throttle valve in such a manner that when the throttle valve is fully closed, as when the engine is idling, the vacuum is of zero level; when the throttle valve is gradually opened from its fully closed position so as to traverse the front area of the vacuum port, the vacuum abruptly increases; when the throttle valve is opened somewhat more, the vacuum decreases in turn as the throttle opening increases; when the throttle valve is opened further so as to exceed approximately 50°, the vacuum remains constant generally in the range of −5 to −60 mm Hg depending upon the rotational speed of the engine; and when the throttle valve is opened still further, the vacuum again gradually increases as the rotational speed of the engine increases. Therefore, if the EGR valve is designed so as to be opened when its diaphragm means is supplied with a vacuum greater than, for example, −60 mm Hg, the EGR system is automatically controlled in a manner such that the exhaust gas recirculation is not effected when the engine is idling, or is operating at low speed with the throttle valve being fully closed or slightly opened, or when the engine is operating at high load with the throttle valve being widely opened, and such that the exhaust gas recirculation is performed only in the medium load operation between idling, or low speed operation, and high load operation. An EGR valve of the aforementioned kind is generally so constructed as to have a relatively sharp on-off performance at its set vacuum so that if the set vacuum is, for example, −60 mm Hg, the EGR valve begins to open when the vacuum supplied to its diaphragm means reaches −60 mm Hg and is nearly fully opened when the vacuum reaches −70 mm Hg.

When exhaust gas recirculation is performed in an engine, it is desirable that the ignition timing of the engine should be advanced at the rate of about one degree by crank angle per 1% of exhaust gas recirculation in order to compensate for the decrease of combustion speed of the fuel-air mixture due to exhaust gas recirculation. However, in the conventional diaphragm type vacuum advancer which has a diaphragm means and is adapted to advance ignition timing in accordance with the vacuum taken from an advancer port similar to the aforementioned vacuum port of the EGR system and supplied to its diaphragm means, because of the mechanical restrictions imposed thereon with regard to the dimensions of the diaphragm means, the rate of advance of ignition timing available relative to the magnitude of vacuum is limited to about 2° by crank angle (1° by distributor angle) per 10 mm Hg increase of vacuum. Therefore, when the engine is operated in such a condition that the vacuum taken out from the vacuum port is slightly greater than the set vacuum of the EGR valve, the EGR valve is already widely opened so as to effect the designed maximum exhaust gas recirculation, while on the other hand the vacuum advancing of ignition timing is yet small or medium thereby causing the engine to operate with a substantially delayed ignition timing in view of the influence of exhaust gas recirculation and therefore to operate with a relatively lower output power and a relatively higher fuel consumption rate.

SUMMARY OF THE INVENTION

It is therefore the object of the present invention to deal with the aforementioned problem and to provide an improved EGR/ignition timing control system which provides such a vacuum advancing of ignition timing that is well adapted to the requirements for vacuum advancing of ignition timing caused by exhaust gas recirculation.

In accordance with the present invention, the above-mentioned object is accomplished by providing an EGR/ignition timing control system in an internal combustion engine having an intake system which has an intake passage, a throttle valve incorporated in said intake passage, and a vacuum port which opens to said intake passage at a position which is upstream of said throttle valve when it is fully closed and which is downstream of said throttle valve when it is opened beyond a predetermined opening, an EGR system having an EGR passage and an EGR valve which has a first diaphragm means and opens said EGR passage when said first diaphragm means is supplied with a vacuum greater than a predetermined level, and a vacuum advancer which has a second diaphragm means and advances ignition timing in accordance with the vacuum supplied to said second diaphragm means, wherein said EGR/ignition timing control system comprises a vacuum switch which is opened or closed in accordance with the vacuum supplied to said first diaphragm means, a solenoid valve which has a solenoid and is opened or closed in accordance with energization or deenergization of said solenoid, an electric circuit which selectively energizes said solenoid in accordance with the operation of said vacuum switch, a check valve, first and second passage means which individually connect said first and second diaphragm means to said vacuum port, said second passage means incorporating therein a parallel connection of said solenoid valve and said check valve, said solenoid valve being adapted to be closed when the vacuum supplied to said first diaphragm means is above a predetermined level and to be opened when the vacuum supplied to said first diaphragm means is below a predetermined level, and said check valve being so directed as to allow fluid to flow only from said second diaphragm means towards said vacuum port.

The operational conditions of said vacuum switch and said solenoid valve may be determined so that when the vacuum supplied to said first diaphragm means is below a predetermined level, the vacuum switch is closed, whereby the solenoid of said solenoid valve is energized by said electric circuit so that the solenoid valve is opened, and so that when the vacuum supplied to said first diaphragm means is above a predetermined level, the vacuum switch is opened, whereby the solenoid of said solenoid valve is deenergized so that the solenoid valve is closed. Alternatively, the on-off operation of said vacuum switch due to the vacuum level above or below a predetermined level may be reversed together with the corresponding reversing of the open-close operational condition of said solenoid valve due to energization or deenergization of its solenoid. However, in view of the fact that exhaust gas recirculation is performed during a substantial portion of the period of operation of the engine, the former operating condition, which deenergizes the solenoid when exhaust gas recirculation is performed, is more desirable.

The vacuum switch, which responds to the vacuum supplied to said first diaphragm means so as to detect operating conditions of the exhaust gas recirculation system and to control operation of the vacuum advancer, may have its own diaphragm means which is supplied with the same vacuum as said first diaphragm means. Alternatively, the vacuum switch may be incorporated in said first diaphragm means so that its switching contacts are actuated by the diaphragm of said first diaphragm means. In this connection, it is desirable that the vacuum switch should be set so as to be actuated by a vacuum which is slightly greater than the set vacuum for the EGR valve so that the vacuum advancing of ignition timing is slightly delayed relative to the exhaust gas recirculation in order to avoid knocking of the engine.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENT

Figure 1:
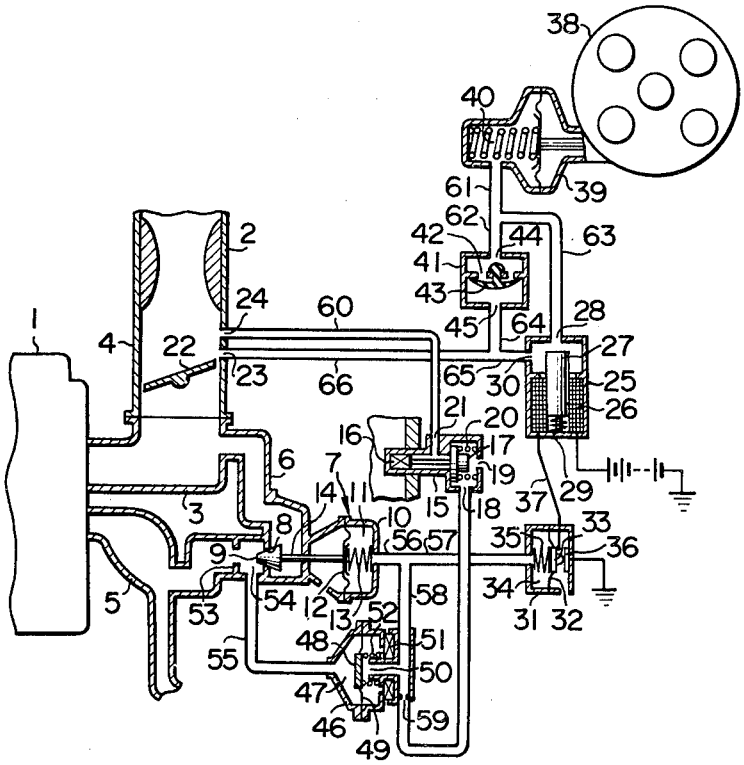
FIG. 1 is a diagrammatical view showing an embodiment of the EGR/ignition timing control system of the present invention.

Referring to FIG. 1, 1 designates an engine which has an intake system 4 including a carburetor 2 and an intake manifold 3, an exhaust system such as an exhaust manifold 5, and an EGR system including a passage means 6 for recirculating a part of the exhaust gases flowing through the exhaust manifold from the exhaust system to the intake system and an EGR valve 7 incorporated in the passage means so as to control the flow of exhaust gases recirculated through the passage means 6. The EGR valve 7 has a valve element 9 which opens or closes a valve port 8 formed in the passage means 6 and a diaphragm means 10 which operates the valve element in such a manner that when the diaphragm chamber 11 of the diaphragm means is not supplied with a vacuum greater than a predetermined level, the diaphragm 12 of the diaphragm means is urged leftwards in the figure by a compression coil spring 13 so as to drive the valve element 9 through a stem 14 toward the valve port 8 thereby intercepting the EGR passage provided by the passage means 6, and when the diaphragm chamber 11 is supplied with a vacuum greater than a predetermined level, the diaphragm 12 is shifted rightward in the figure against the action of the compression coil spring 13 so as to remove the valve element 9 from the valve port 8 thereby opening the EGR passage provided by the passage means 6.

15 is a thermostat valve which responds to engine temperature and comprises a thermostat portion 16 adapted to detect, for example, the temperature of engine cooling water which represents engine temperature and a valve element 17 adapted to be actuated by the thermostat portion. When engine temperature is below a predetermined value, the valve element 17 is shifted to the position shown in FIG. 1 so as to connect a port 18 to an atmospheric port 19 while interrupting connection between the port 18 and a port 21, while on the other hand if engine temperature is above a predetermined value, the valve element 17 is shifted rightward in the figure by the thermostat element 16 against the action of a compression coil spring 20 so as to isolate the port 18 from the atmospheric port 19 and to connect the port 18 to the port 21. By this thermostat valve being incorporated in the EGR/ignition timing control system of the present invention, the control system is actuated only when engine temperature is above a predetermined value.

22 designates a throttle valve incorporated in the intake system of the engine. 23 and 24 designate two vacuum ports which individually open to the intake passage of the intake system at positions which are upstream of the throttle valve 22 when it is fully closed and which are downstream of the throttle valve when it is opened beyond a predetermined opening. Although the ports 23 and 24 are arranged vertically spaced in FIG. 1, this arrangement is only for the purpose of illustration and the two vacuum ports are actually arranged closely spaced along the circumference of the cylindrical intake bore of the carburetor 2.

25 designates a solenoid valve having a solenoid 26 and a core 27 which is magnetically driven by the solenoid and operates as a valve element which opens or closes a valve port 28. When the solenoid 26 is not energized, the core 27 is pushed upward in the figure by a compression coil spring 29 so as to interrupt communication between ports 28 and 30. By contrast, when the solenoid 26 is energized, the core 27 is driven downward in the figure against the action of the compression coil spring 29 so as to open the port 28 and to establish communication between the ports 28 and 30.

31 designates a vacuum switch having a diaphragm 32 which supports a contact point 33. When the diaphragm chamber 34 of the vacuum switch is not supplied with a vacuum greater than a predetermined level, the diaphragm 32 is shifted rightward in the figure by a compression coil spring 35 so as to make the contact point 33 contact a mating contact point 36. By contrast, when the diaphragm chamber 34 is supplied with a vacuum greater than a predetermined level which is slightly greater than the vacuum at which the EGR valve 7 is opened, the diaphragm 32 is shifted leftward in the figure against the action of the compression coil spring 35 so as to interrupt the contact between the contact points 33 and 36. This vacuum switch controls an electric circuit 37 which supplies electric power to the solenoid 26 of the solenoid valve 25.

38 designates a distributor and 39 designates a vacuum advancer which operates upon the distributor. The vacuum advancer has a diaphragm chamber 40 and is adapted to increase vacuum advancing of ignition timing in accordance with increase of the vacuum supplied to the diaphragm chamber 40.

41 designates a check valve which has a valve element 43 which opens or closes a port 42 so as to allow fluid to flow only from its port 44 to its port 45.

46 designates a back pressure control valve for the EGR system. When the pressure of exhaust gases acting in the diaphragm chamber 47 of the back pressure control valve is below a predetermined level, its diaphragm 49 supporting a valve element 48 is shifted leftward in the figure so as to open its port 50 to the atmosphere through an air filter 51. By contrast, when the diaphragm chamber 47 is supplied with exhaust gas pressure greater than a predetermined level, the diaphragm 49 is shifted rightward in the figure against the action of a compression coil spring 52 so as to close the port 50. The diaphragm chamber 47 is supplied with the exhaust gas pressure existing in a chamber 54 defined at a middle portion of the EGR passage provided by the passage means 6 and located downstream of an orifice means 53, said pressure being conducted through a passage means 55. This control system including the back pressure control valve 46 and the orifice means 53 operates to control the vacuum supplied to the diaphragm chamber 11 of the EGR valve 7 so that the exhaust gas pressure in the chamber 54 is maintained at a constant level and so that EGR ratio is maintained at a constant value.

The diaphragm chamber 11 of the EGR valve 7 and the diaphragm chamber 34 of the vacuum switch 31 are connected to the port 18 of the thermostat valve 15 by passage means 56 and 57 respectively, and a passage means 58. At a middle portion of the passage means 58 is provided an orifice means 59, and at the side of the orifice means 59 that is closer to the EGR valve 7 the passage means 58 is connected to the port 50 of the back pressure control valve 56. The port 21 of the thermostat valve 15 is connected to the vacuum port 24 by a passage means 60. The diaphragm chamber 40 of the vacuum advancer 39 is connected to the port 44 of the check valve 41 by passage means 61 and 62 on the one hand, and on the other hand the diaphragm chamber 40 is connected to the port 28 of the solenoid valve 25 by passage means 61 and 63. The port 45 of the check valve 41 and the port 30 of the solenoid valve 25 are connected to the vacuum port 23 by passage means 64 and 65, respectively, and a passage means 66. In this connection, the vacuum for the vacuum advancer 39 is taken out from a vacuum port such as 23 which is separate from the vacuum port 24 for taking out vacuum for the EGR valve 7 because the vacuum in the vacuum passage means for the EGR valve is sometimes smaller than the vacuum which appears in the vacuum port 23 due to modification effected by the back pressure control system, such a modified vacuum being unsuitable for operating the vacuum advancer.

The EGR/ignition timing control system shown in FIG. 1 operates as follows. When engine temperature is below a predetermined value so that the valve element 17 of the thermostat valve 15 is shifted leftward in the figure thereby opening the port 18 to the atmosphere while intercepting connection between the ports 18 and 21, the diaphragm chamber 11 of the EGR valve 7 and the diaphragm chamber 34 of the vacuum switch 31 are supplied with atmospheric pressure. In this condition the port 8 of the EGR valve is closed so that no exhaust gas recirculation is effected. Also in this condition the contact points 33 and 36 of the vacuum switch 31 contact with each other so that the solenoid 26 of the solenoid valve 25 is energized thereby shifting the core 27 downward in the figure against the action of the compression coil spring 29 so that the ports 28 and 30 are connected with each other. In this condition, therefore, the diaphragm chamber 40 of the vacuum advancer 39 is constantly connected with the vacuum port 23 by way of the passage including the solenoid valve 25. In this condition no exhaust gas recirculation is effected while on the other hand vacuum advancing of ignition timing is performed in the conventional manner in accordance with opening of the throttle valve 22.

When engine temperature rises above a predetermined value so that the valve element 17 of the thermostat valve 15 is shifted rightward in the figure against the action of the compression coil spring 20 thereby connecting the ports 18 and 21 with each other, the diaphragm chamber 11 of the EGR valve 7 and the diaphragm chamber 34 of the vacuum switch 31 are connected with the vacuum port 24. In this condition the exhaust gas recirculation is performed in accordance with opening of the throttle valve 22. That is, if the throttle valve 22 is fully closed, i.e. if the engine is idling or operating at low speed, no substantial vacuum appears in the vacuum port 24, whereby the EGR valve 7 is closed. In this condition, therefore, no exhaust gas recirculation is effected. When the throttle valve 22 is gradually opened from its full closed position so as to traverse the front area of the vacuum ports 23 and 24, the vacuum in these vacuum ports abruptly increases and when the vacuum increases beyond a predetermined set level for the EGR valve 7, the valve is opened so as to effect exhaust gas recirculation. When the throttle valve 22 is further opened, the vacuum in the vacuum ports 23 and 24 reaches the maximum value and then begins to decrease gradually until it finally traverses the set level downward so that the EGR valve 7 is again closed.

If the vacuum switch 31 is so designed that the critical vacuum level for the on and off operation of the contact points 33 and 36 is substantially the same as the critical vacuum level for the on and off operation of the EGR valve 7 except for the aforementioned slight difference for avoiding engine knocking, the contact points 33 and 36 are opened when the EGR valve 7 is opened so as to effect exhaust gas recirculation, and when the EGR valve 7 is closed so as not to effect exhaust gas recirculation, the contact points 33 and 36 are closed. Based upon this operation of the vacuum switch 31, the ports 28 and 30 of the solenoid valve 25 are isolated from each other when exhaust gas recirculation is effected, and when the exhaust gas recirculation is not effected, the ports 28 and 30 are connected with each other. When the throttle valve 22 is opened from its full closed position, the vacuum in the vacuum ports 23 and 24 rapidly increases, and reaches the maximum level when the throttle valve is opened to a relatively small opening, and since the connection between the ports 28 and 30 of the solenoid valve 25 is interrupted at that time, the abovementioned maximum vacuum is, when it has once been supplied to the diaphragm chamber 40 of the vacuum advancer 39, trapped in the space including the diaphragm chamber 40 and the passage means 61, 62 and 63 by the checking action of the check valve 41. Therefore, even when the throttle valve 22 is further opened so that the vacuum in the vacuum ports decreases from the maximum level, the vacuum advancing of ignition timing provided by the vacuum advancer 39 is maintained at the value corresponding to the maximum vacuum.

Figure 2:
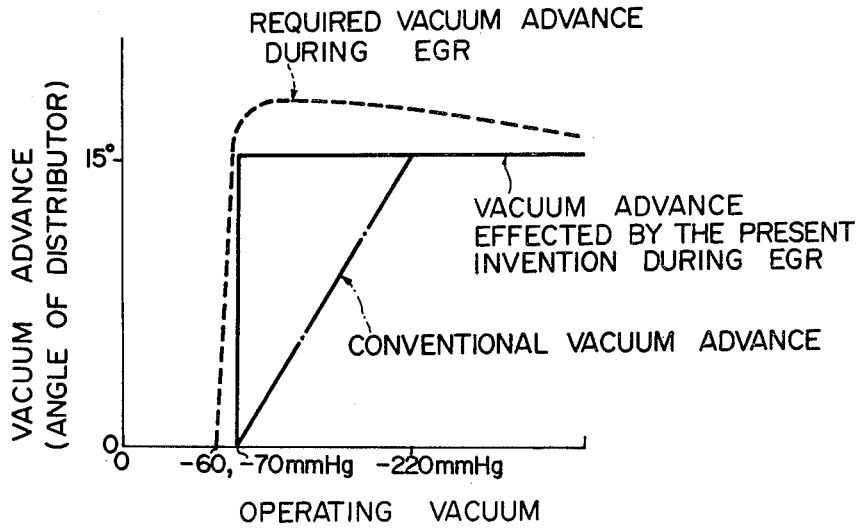
FIG. 2 is a graph showing the vacuum advancing performance of the system shown in FIG. 1 and that of a conventional vacuum advancer for the purpose of comparison.

In the graph of FIG. 2 the vacuum advancing of ignition timing obtained by the control system of the present invention for EGR operation of the engine is shown as compared with the vacuum advancing available from a conventional vacuum advancer. In this graph the ordinate and the abscissa each bear scales for the sake of example only. The vacuum advancing performance desirable for EGR operation of the engine is shown by a broken line in the graph, and it will be appreciated that the vacuum advancing performance obtained by the control system of the present invention shown by a solid line is very close to the aforementioned desirable performance.

When the vacuum in the vacuum ports 23 and 24 lowers below the set vacuum of the EGR valve 7, the valve 7 is closed so as to stop the exhaust gas recirculation, and at the same time the contact points 33 and 36 of the vacuum switch 31 contact with each other so that the solenoid 26 of the solenoid valve 25 is energized thereby connecting the ports 28 and 30 with each other, whereby the maximum vacuum trapped in the diaphragm chamber 40 of the vacuum advancer 39 is immediately released so that the vacuum advancing is reduced substantially to zero.

Figure 3A:
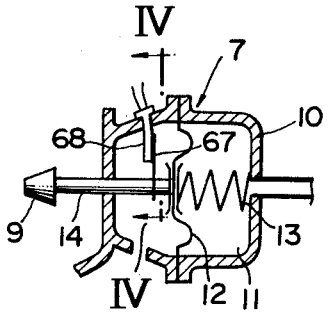
FIGS. 3*a* and 3*b* are diagrammatical sectional views showing another embodiment of the vacuum switch which is incorporated in the diaphragm means of the EGR valve, in ON and OFF conditions, respectively.
Figure 3B:
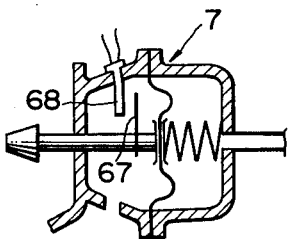
Figure 4:
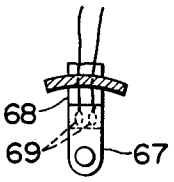
FIG. 4 is a view along line IV—IV in FIG. 3*a;*

FIGS. 3*a* and 3*b* correspond to a portion of FIG. 1, and show a modification of the diaphragm means 10 of the EGR valve 7 which incorporates a vacuum switch corresponding to the vacuum switch 31 in FIG. 1. In FIGS. 3*a* and 3*b* the portions corresponding to those shown in FIG. 1 are designated by the corresponding reference numerals. In this case, the stem 14 supports an elastic metal plate 67, while on the other hand the housing of the diaphragm means 10 supports a contact plate 68 having two contact points 69, which are electrically connected with each other by the metal plate 67 when the latter contacts the former as shown in FIG. 3*a*, and which are electrically disconnected from each other when the latter is removed from the former as shown in FIG. 3*b*. By incorporating this contact device in the diaphragm means 10 of the EGR valve 7 and by controlling the electric circuit 37 by this contact device, a third diaphragm means such as 32, 34, and 35 for the vacuum switch 31 can be omitted.

Figure 5:
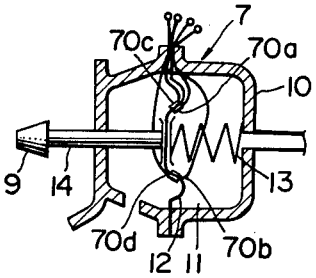
FIG. 5 is a view similar to FIGS. 3*a* and 3*b,* showing still another embodiment of the vacuum switch.
Figure 6:
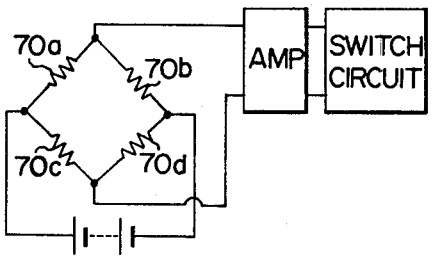
FIG. 6 is an electric circuit diagram which incorporates the strain gauges included in the switching structure shown in FIG. 4.

FIG. 5 is a view similar to FIGS. 3*a* and 3*b* showing still another embodiment of the vacuum switch incorporated in the diaphragm means of the EGR valve. In this case, four strain gauges 70*a*–70*d* are mounted to the diaphragm 12. These strain gauges are incorporated in a bridge circuit such as shown in FIG. 6 and provide an ON-OFF switching operation in accordance with shifting of the diaphragm 12 effected by the vacuum supplied to the diaphragm chamber 11. Also in this case, the electric circuit 37 for the solenoid valve 25 can be controlled in the same manner as in the embodiment shown in FIG. 1, without employing a third diaphragm means such as 32, 34, and 35.

Although the invention has been shown and described with respect to a preferred embodiment thereof, it should be understood by those skilled in the art that various changes and omissions of the form and detail thereof may be made therein without departing from the scope of the invention.

I claim:

1. In an internal combustion engine having an intake system which has an intake passage, a throttle valve incorporated in said intake passage, and a vacuum port which opens to said intake passage at a position which is upstream of said throttle valve when it is fully closed and which is downstream of said throttle valve when it is opened beyond a predetermined opening, an EGR system having an EGR passage and an EGR valve which has a first diaphragm means and opens said EGR passage when said first diaphragm means is supplied with a vacuum greater than a predetermined level, and a vacuum advancer which has a second diaphragm means and advances ignition timing in accordance with the vacuum supplied to said second diaphragm means, an EGR/ignition timing control system comprising a vacuum switch which is opened or closed in accordance with the vacuum supplied to said first diaphragm means, a solenoid valve which has a solenoid and is opened or closed in accordance with energization or deenergization of said solenoid, an electric circuit which selectively energizes said solenoid in accordance with the operation of said vacuum switch, a check valve, first and second passage means which individually connect said first and second diaphragm means to said vacuum port, said second passage means incorporating therein a parallel connection of said solenoid valve and said check valve, said solenoid valve being adapted to be closed when the vacuum supplied to said first diaphragm means is above a predetermined level and to be opened when the vacuum supplied to said first diaphragm means is below a predetermined level, and said check valve being so directed as to allow fluid to flow only from said second diaphragm means toward said vacuum port.

2. The system of claim 1, wherein said vacuum switch has a third diaphragm means supplied with the same vacuum as that supplied to said first diaphragm means, and a contact means operated by said third diaphragm means.

3. The system of claim 1, wherein said vacuum switch has a contact means operated by said first diaphragm means.

4. The system of claim 1, 2, or 3, wherein said vacuum switch is so adapted that it is opened when said first diaphragm means is supplied with a vacuum greater than a predetermined level and is closed when the vacuum supplied to said first diaphragm means is below a predetermined level, and wherein said solenoid valve is so adapted that it is opened when said solenoid is energized and is closed when said solenoid is deenergized.

5. The system of claim 1, 2, or 3, further comprising a thermostat valve incorporated in said first passage means, said thermostat valve being adapted to respond to engine temperature and to open said first diaphragm means to the atmosphere when engine temperature is below a predetermined value.

6. The system of claim 1, 2, or 3, further comprising a back pressure control system combined with said EGR system and including a back pressure control valve and an orifice means provided in said EGR passage upstream of said EGR valve so as to define a constant pressure chamber in said EGR passage upstream of said EGR valve, said pressure control valve having a diaphragm means which is operated by the pressure in said constant pressure chamber and selectively opens a middle portion of said first passage means to the atmosphere when the pressure in said constant pressure chamber is below a predetermined pressure level.

7. The system of claim 6, wherein said vacuum port is provided in duplicate including first and second vacuum ports, said first diaphragm means being connected to said first vacuum port while said second diaphragm means is connected to said second vacuum port.

8. The system of claim 3, wherein said vacuum switch includes a plurality of strain gauges mounted to the diaphragm of said first diaphragm means, and a bridge electric circuit which incorporates said strain gauges and a switching circuit.

* * * * *